US005841407A

United States Patent [19]

Birnbaum

[11] Patent Number: 5,841,407

[45] Date of Patent: Nov. 24, 1998

[54] MULTIPLE-TUNED NORMAL-MODE HELICAL ANTENNA

[75] Inventor: Thomas J. Birnbaum, Scotts Valley, Calif.

[73] Assignee: ACS Wireless, Inc., Scotts Valley, Calif.

[21] Appl. No.: 729,428

[22] Filed: Oct. 11, 1996

[51] Int. Cl.[6] ..... H01Q 1/36

[52] U.S. Cl. ..... 343/895; 343/745; 343/749

[58] Field of Search ..... 343/745, 749, 343/702, 722, 895

[56] References Cited

U.S. PATENT DOCUMENTS

| | | | |
|---|---|---|---|
| 2,482,767 | 9/1949 | Hansen | 343/895 |
| 2,503,010 | 4/1950 | Tiley | 250/33 |
| 2,875,443 | 2/1959 | Kandoian | 343/895 |
| 2,963,704 | 1/1960 | Yates et al. | 343/895 |
| 3,383,695 | 5/1968 | Jarek | 343/895 |
| 3,568,205 | 3/1971 | Buxton et al. | 343/895 |
| 3,569,977 | 3/1971 | Koller | 343/895 |
| 4,137,534 | 1/1979 | Goodnight | 343/752 |
| 4,148,030 | 4/1979 | Foldes | 343/895 |
| 4,217,589 | 8/1980 | Stahler | 343/722 |
| 4,229,743 | 10/1980 | Vo et al. | 343/749 |
| 4,270,128 | 5/1981 | Drewett | 343/702 |
| 4,335,386 | 6/1982 | Johns | 343/722 |
| 4,489,276 | 12/1984 | Yu | 324/338 |
| 4,772,895 | 9/1988 | Garay et al. | 343/895 |
| 4,800,395 | 1/1989 | Balzano et al. | 343/895 |
| 5,359,340 | 10/1994 | Yokota | 343/792 |
| 5,365,247 | 11/1994 | Van der Veen et al. | 343/702 |

OTHER PUBLICATIONS

John D. Kraus, Antennas, Second Edition, 1988, Copyright McGraw–Hill, Inc., pp. 265–338.

*Primary Examiner*—Hoanganh T. Le
*Assistant Examiner*—Tan Ho
*Attorney, Agent, or Firm*—Limbach & Limbach, LLP

[57] ABSTRACT

An antenna includes a conductive coil electrically coupled to a wave launching structure and configured such that a plurality of capacitances act electrically in parallel with a plurality of distinct portions of the conductive coil. The capacitances configure what would otherwise be a conventional normal-mode helical antenna for operation at multiple, closely spaced resonance frequencies. The antenna operates at the multiple resonance frequencies with only a small loss of efficiency relative to the maximum response of a conventional normal-mode helical antenna that has a single resonance frequency. Also, the antenna in accordance with the invention is self-duplexing, eliminating the need for complex and expensive duplexing circuitry.

19 Claims, 7 Drawing Sheets

MULTIPLE-TUNED NORMAL-MODE HELICAL ANTENNA

TECHNICAL FIELD

The present invention relates generally to helical antennae, and, more particularly, to a compact normal-mode helical antenna operable at a plurality of closely-spaced, yet well-defined frequencies.

BACKGROUND

Helical antennae can be divided into two very different categories, normal-mode and axial-mode (or helical beam). The categorization of a helical antenna into one of these two categories depends on the electrical and physical length of the antenna, and the circumference and the number of turns in the helix of the antenna. A helical antenna must be less than 0.5 wavelengths in both circumference and physical height in order to be classified as a normal-mode helical antenna. A typical normal mode helical antenna is much smaller, about 0.005 wavelengths in circumference and 0.05 wavelengths in physical height. A normal-mode helical antenna produces a radiation pattern with a maximum in all directions normal to the axis of the antenna. The normal-mode helical radiates a linearly-polarized wave with the electric field parallel to the axis of the antenna. By contrast, an axial-mode helical antenna produces a radiation pattern with a maximum directed outward from the top end of the antenna (along the helix axis). The axial-mode mode helical antenna produces a circularly-polarized wave. The present disclosure addresses only normal-mode helical antennae. For more background on normal-mode (and axial-mode) helical antennae, the reader is referred to Chapter 7 of *Antennas* (2nd Ed.), by John D. Kraus (McGraw Hill, 1988).

FIG. 1 illustrates a conventional normal-mode helical antenna 100. Referring to FIG. 1, the conventional normal-mode helical antenna 100 includes a conductive coil 102 that has a feed end 106 electrically connected to an inner conductor of a coaxial cable. The outer conductor 104 of the coaxial cable is electrically connected to a ground plane 107. The conductive coil 102 includes a conducting wire. The conducting wire has been wound around an insulating core (a dielectric material or even air) such that the physical length and the circumference of each turn of the conductive coil 102 are much less than a wavelength. The conductive coil 102 also has an open end 108. Coaxial cable, with the outer conductor connected to a flat ground plane 107, as illustrated in FIG. 1, is just one possible type of "wave launching structure". Others, such as coaxial cable with the outer conductor connected to a cupped ground plane or a deep conical ground plane are illustrated in Chapter 7 of the *Antennas* (p. 278) referenced above. Even a "back-fire" wave launching structure may be provided (see *Antennas,* pp. 328–329).

The conductive coil 102 includes multiple turns all having the same helicity (i.e., wound in the same direction). The coil 102 exhibits significant inductance, due to the windings. When the coil 102 is coupled to the inner conductor 103 of the coaxial cable to form a conventional normal-mode helical antenna 100, the coil 102 also has a shunt capacitance to the ground plane 107 (See FIG. 3). The number of turns and other physical characteristics of the coil 102 determine the basic operating frequency or resonance mode of the coil 102. A normal-mode helical antenna 100 typically exhibits multiple resonances; the first resonance is typically the one of interest. As discussed above, the coil of wire 102 forming the helical antenna has a series inductance (L) and, when mounted over a ground plane 107, a shunt capacitance (C) to the ground plane 107. The combination of series inductance and shunt capacitance, which is distributed over the length of the antenna, forms a transmission line. The characteristic impedance, or $Z_o$, of any transmission line is defined as:

$$Z_o=\sqrt{(L/C)},$$

where L is in Henrys/meter and C is in Farads/meter.

The phase velocity ($v_p$) of a transmission line is defined as:

$$v_p=1/\sqrt{(LC)}.$$

The phase velocity of any transmission medium is the velocity with which energy will propagate through the medium and is dependent upon the electrical characteristics of the medium at the frequency of interest.

The velocity factor (the ratio of the phase velocity to the speed of light in air) of the line can be found as:

$$velocity\ factor=v_p/c,$$

where c is the speed of light ($3\times10^8$ meters/sec).

Using typical values for L and C from conventional helical antenna geometry, $Z_o$ falls in the range of 1000 to 2500 ohms while the velocity factor is in the 0.05 to 0.20 range. The combination of very high $Z_o$ and low velocity factor, when combined with the slight attenuation of the signal (created by the wire resistance) causes the open circuit at one end of the transmission line (the open end 108) to be transformed to a 50 ohm impedance (with zero reactance) at the other end of the transmission line (the feed end 106). The conventional normal-mode helical antenna is electrically one-quarter of a wavelength long at the first resonant frequency.

FIG. 2 graphically illustrates the frequency response of a conventional normal-mode helical antenna 100 having the following characteristics:

| | |
|---|---|
| resonance frequency (f, 202) | 49.375 MHz |
| 3dB bandwidth (204) | 1.5 MHz |
| number of turns | 150 |
| diameter | 0.25" |
| physical length (L) | 3.5" |
| electrical length (EL) | 59" |

Referring to FIG. 2, the measured frequency response of the conventional normal-mode helical antenna 100 having these characteristics exhibits a resonance frequency (f) 202 at 49.375 MHz. The bandwidth 204 at the 3 dB points 206 and 208 in this exemplary response is 1.5 MHz.

Consider the following example. In some portable apparatuses (such as a cordless phone), a receiver and transmitter (each requiring an antenna) are operating in a small physical space at frequencies that are only 3–4 MHz apart. If a conventional normal-mode helical antenna is employed, configured to be tuned to a frequency 202 between the two desired frequencies 1000,1001 (i.e., between the receiver and transmitter frequencies), the response at each frequency will be far below the maximum response that could be achieved for one of the desired frequencies if the resonance was placed exactly at that desired frequency. This frequency response differential 212 may be as much as 15 dB. In addition, if a conventional normal-mode helical antenna is configured to be tuned to a frequency 202 corresponding to the receiver frequency 1000, the response at the transmitter frequency 1001 will be still further below the response at the receiver frequency. This frequency response differential may be as much as 20 dB. It is clear from this example that a conventional normal-mode helical antenna used at separate transmit and receive frequencies will compromise the system performance.

FIG. 3 schematically illustrates a transmission line model of the conventional normal mode helical antenna 100 of FIG. 1. Referring to FIG. 3, a combination of series inductance (L), shunt capacitance (C) and loss resistance (R) is distributed over the length of the coil 102, which forms a transmission line 300. The shunt conductance (G) is ignored in this case. The transmission line 300 has a feed end 106 and an open end 108.

The characteristic impedance, or $Z_0$, of the transmission line 300 was defined earlier as:

$$Z_0=\sqrt{(L/C)} \text{ (ignoring the loss R)}$$

Typical values of L and C for a normal-mode helical antenna constructed at a nominal frequency of 50 MHz are:

L=125 to 150 microhenries/meter

C=16 to 20 picofarads/meter

These values result in a $Z_0$ of 2000 to 3000 ohms with a velocity factor of 0.06 to 0.08. The combination of very high $Z_0$ and low velocity factor, when combined with the slight attenuation of the signal (created by loss resistance in the wire) causes the open circuit at the open end 108 of the transmission line 300 to be transformed to a 50 ohm impedance (with zero reactance) at the feed end 106 of the transmission line 300. The result is that the conventional normal-mode helical antenna has a sharp resonance frequency band in its frequency response.

The Q (quality factor) of an antenna resonance provides an indication of the sharpness of the resonance. The higher the Q of a resonance, the narrower the frequency response and, thus, the greater resolution from background noise and other signals. Conventional normal-mode helical antennae, especially when physically very short, are sharply tuned (i.e., with Q's from about 20 to 75) to a narrow band of frequencies. (By contrast, a quarter-wave resonant monopole antenna has a Q of about 3).

The high-Q nature of the normal-mode helical antenna is both a strength and a weakness. While the narrow frequency response provides "free" front-end filtering, due to its steep slope, it also limits the use of the conventional normal-mode helical antenna to a narrow frequency range. This makes the normal-mode helical antenna generally unsuited for use at two separate frequencies, even when those frequencies are relatively close together.

Typically, when it is desired to employ a single conventional normal-mode helical antenna at two frequencies, the normal-mode helical antenna is configured to be tuned either to one of the frequencies, or to a frequency which is midpoint between the two frequencies. As described quantitatively above and shown in FIG. 2, both configurations have significant disadvantages. First, when a conventional normal-mode helical antenna is configured to be tuned to one of the frequencies, performance is significantly compromised for the other of the frequencies. Furthermore, when a conventional normal-mode helical antenna is configured to be tuned to a frequency which is midpoint between the two frequencies, performance is compromised for both frequencies.

Thus, to achieve optimum performance at multiple desired frequencies, multiple separate antennae are conventionally used, with each separate antenna tuned to a separate one of the desired frequencies. However, if such antennae are not electrically isolated when coupled, the result is a single broad resonance frequency band. For example, U.S. Pat. No. 4,772,895 of Garay discloses an antenna that includes two mechanically coupled helical elements 20,40. If the helical elements 20,40 were electrically isolated from each other, each helical element 20,40 would resonate at a different frequency. However, Garay discloses coupling the helical elements 20, 40 to achieve resonance at a single broadened range of frequencies. U.S. Pat. No. 4,270,128 of Drewitt also discloses an antenna that includes two helical elements 26,28 to achieve resonance within a single broadened range of frequencies.

By contrast to Garay and Drewitt, U.S. Pat. No. 4,229,743 of $V_0$ discloses a single structure 10 which includes two helical elements $L_1$,$L_2$ placed end-to-end and electrically isolated from each other. The helical elements $L_1$, $L_2$ are configured to be tuned to two distantly-spaced frequency bands—the FM band (approximately 98 MHz) and the CB band (approximately 27.09 MHz)—while being mechanically coupled to each other. Specifically, a complex impedance network 12 is employed to electrically isolate the helical elements $L_1$, $L_2$ from each other. The end-to-end configuration of the Vo helical elements $L_1$, $L_2$ and the $V_0$ linear radiator 11 makes the resulting structure too long and bulky to be useful in many applications where portability is essential. For example, the significant length of the linear radiator 11 alone renders the system too large for such portable applications.

In addition, for portable applications that require operation at multiple closely-spaced frequencies, duplexing is generally required. For example, a typical cordless phone includes both a receiver and a transmitter in both the handset and the base station. Because the transmitter is located only inches from the receiver, the receiver is subject to very strong interference from the transmitter. Most of the unwanted signal enters the system through the receiver antenna. A duplexing circuit is typically used in the front end of the receiver to eliminate the strong signal from the local transmitter. Duplexers are difficult to design, add significant signal loss at the receiver input, and raise the price of the final product.

SUMMARY OF THE INVENTION

An antenna in accordance with the present invention includes a conductive coil electrically coupled to wave launching structure and configured such that a plurality of capacitances act electrically in parallel with a plurality of distinct portions of the conductive coil.

The capacitances configure what would otherwise be a conventional normal-mode helical antenna for operation at multiple, closely spaced resonance frequencies. The antenna operates at the multiple resonance frequencies with only a small loss of efficiency relative to the maximum response of a conventional normal-mode helical antenna that has a single resonance frequency. Also, the antenna in accordance with the invention is self-duplexing, eliminating the need for complex and expensive duplexing circuitry.

A better understanding of the features and advantages of the invention will be obtained by reference to the following detailed description and accompanying drawings which set forth an illustrative embodiment in which the principles of the invention are utilized.

DETAILED DESCRIPTION

Figure 4:
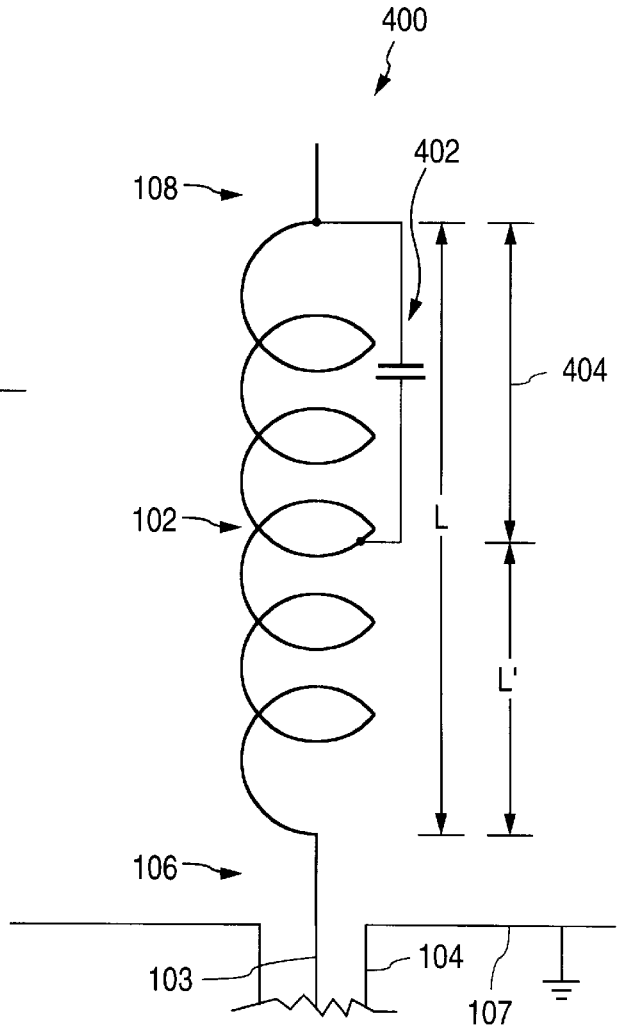
FIG. 4 shows a multiple-tuned normal-mode helical antenna in accordance with the first embodiment of the present invention.

FIG. 4 illustrates a multiple-tuned normal-mode helical antenna in accordance with the first embodiment 400 of the present invention. The multiple-tuned normal-mode helical antenna in accordance with the first embodiment 400 of the present invention includes a first conductive coil 102.

In one example of the first embodiment, a conventional normal-mode helical antenna is constructed by placing 150 turns of #26 gauge wire on a insulating 0.25" diameter core. The antenna is 2.9" tall. The antenna resonates at 49.375 MHz and has a 3 dB bandwidth of 1.7 MHz; the Q of the antenna response is 29. A wide range of wire gauges may be used (#14 to #40 are practical) for the coil 102.

The multiple-tuned, normal-mode helical antenna in accordance with the first embodiment 400 further includes capacitor circuitry coupled to act electrically in parallel with a portion (L-L') 404 of the first coil 102. In a preferred embodiment, the capacitor circuitry 402 is a discrete capacitor (although it is within the scope of the invention to employ other means for creating a capacitance that acts electrically in parallel with the portion 404 of the first coil 102). Also in a preferred embodiment, the capacitor circuitry 402 is coupled to the first coil 102 from the open end 108 of the first coil 102 to a point located on the first coil 102 a distance L' from the feed end 106.

Figure 1:
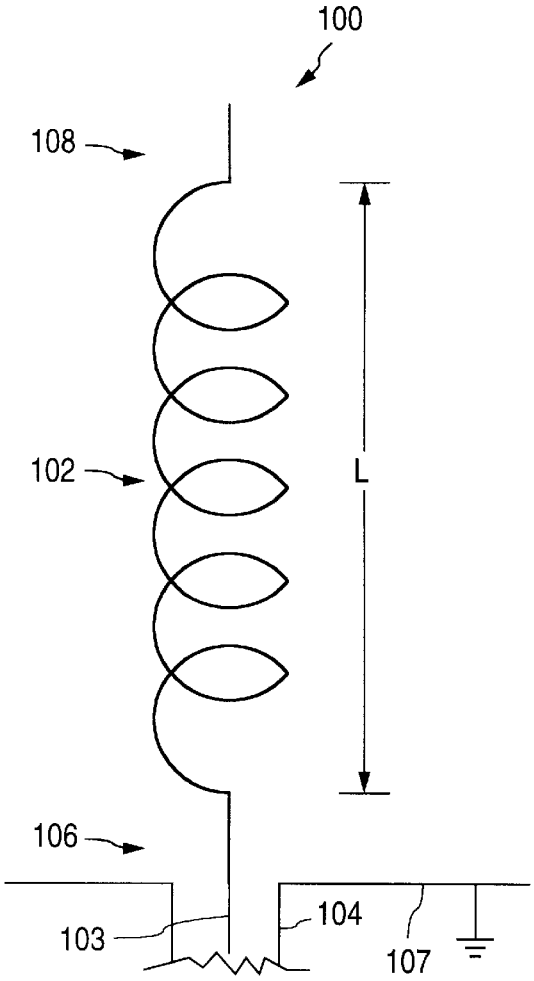
FIG. 1 (PRIOR ART)
FIG. 1 shows a conventional normal-mode helical antenna.
Figure 6:
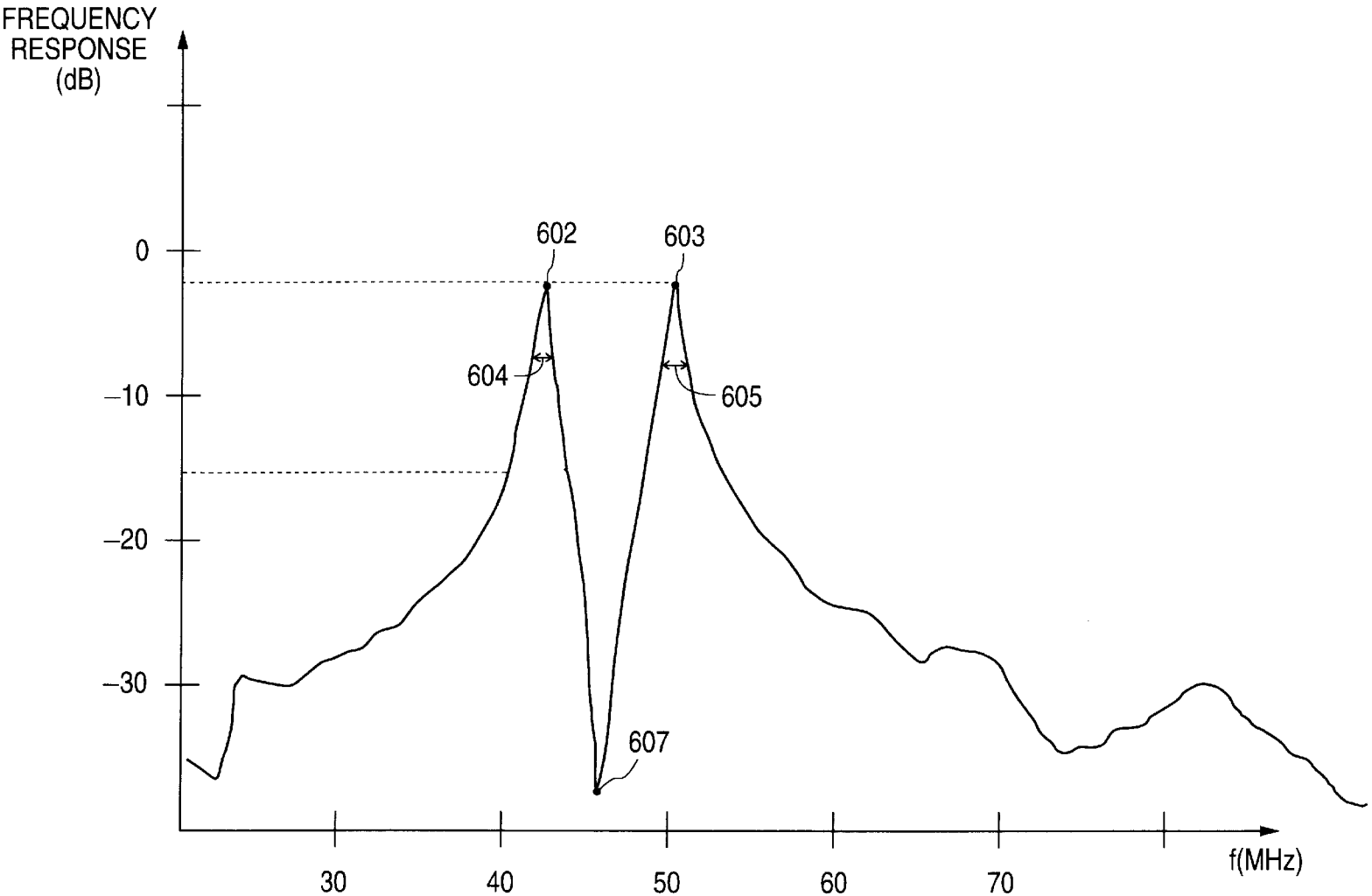
FIG. 6 shows the frequency response of the antenna of FIG. 4, having a 3.6 picofarad capacitor acting electrically in parallel with 47 turns of its conductive coil.

FIG. 6 graphically illustrates the frequency response of the multiple-tuned normal-mode helical antenna 400 in accordance with the first embodiment of the present invention. Referring now to FIG. 6, it can be seen that the normal-mode helical antenna 400 exhibits two narrow resonance frequency bands 602, 603. The two resonance frequency bands 602, 603 are generally centered about the single resonance frequency of a conventional normal-mode helical antenna (i.e., the antenna 100 shown in FIG. 1) which has the same characteristics (i.e., electrical and physical length, diameter, circumference and number of turns in the helix). In addition, an antiresonance notch 607 is located at a frequency between the resonance frequency maxima 602, 603.

The normal-mode antenna whose frequency response is illustrated in FIG. 6 has the following characteristics:

| | |
|---|---|
| number of turns of first coil (102) | 150 |
| capacitance of capacitor (402) | 7.25 pF |
| number of turns of first coil (102) with which capacitor circuitry (402) acts in parallel (404) | 23 |
| diameter of first coil (102) | 0.25" |
| physical length (L) of first coil (102) | 2.9" |
| resonance frequencies (602, 603) | ~43 MHz, ~51 MHz, respectively |
| frequency of antiresonance notch (607) | ~45.8 MHz |
| 3dB bandwidths (604, 605) | ~1 MHz |

Figure 2:
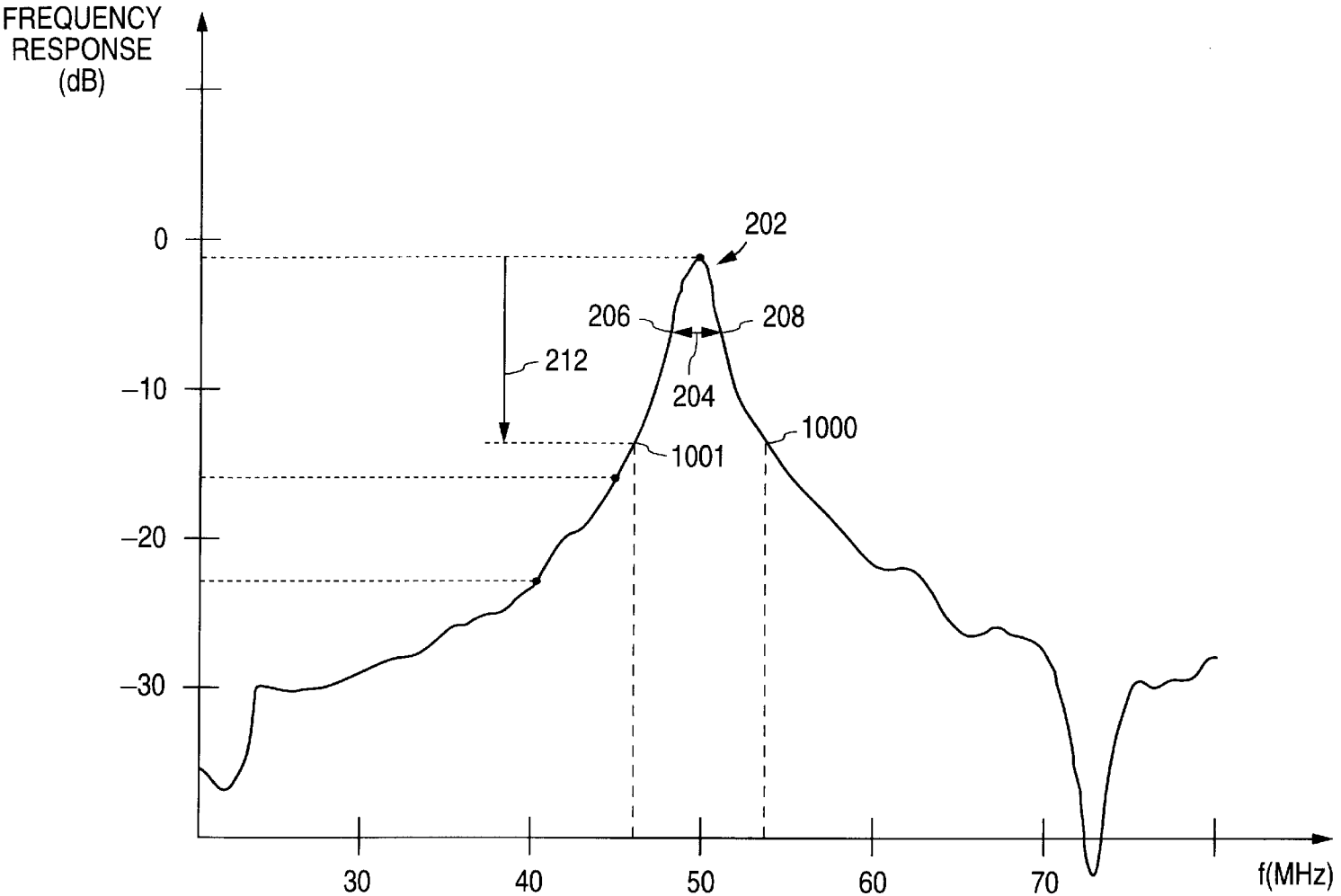
FIG. 2 (PRIOR ART)
FIG. 2 graphically shows a measured frequency response of the conventional normal-mode helical antenna 100 of FIG. 1.
Figure 3:
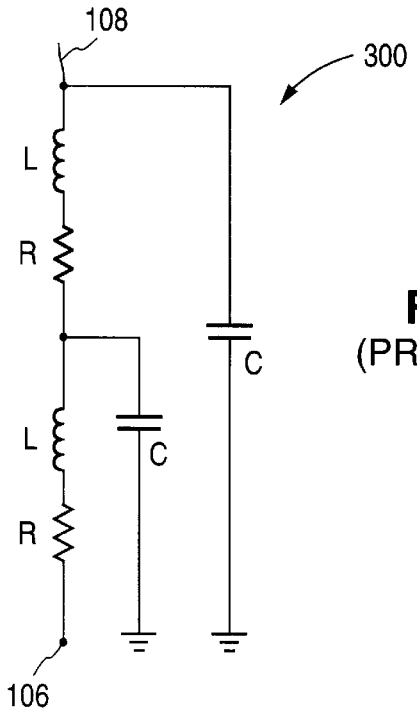
FIG. 3 (PRIOR ART)
FIG. 3 schematically illustrates a transmission line model of the conventional normal-mode helical antenna of FIG. 1.

It can be seen by comparison of the frequency response graph in FIG. 6 with the frequency response graph in FIG. 2 that the response maxima of an antenna in accordance with the first embodiment 400 are reduced by less than about 1 to 3 dB from the maximum response that could be achieved for one of the desired frequencies if the resonance frequency of the conventional normal-mode helical antenna was placed exactly at that desired frequency.

Referring still to FIG. 6, it can be seen that the presence of an antiresonance notch 607, located at a frequency between resonance frequency maximum 602 and resonance frequency maximum 603 renders the first embodiment of the multiple-tuned normal-mode helical antenna self-duplexing. That is, the characteristics of the antenna may be chosen such that the antiresonance notch occurs at the same frequency as a strong interfering signal, such as a nearby transmitter.

Figure 7:
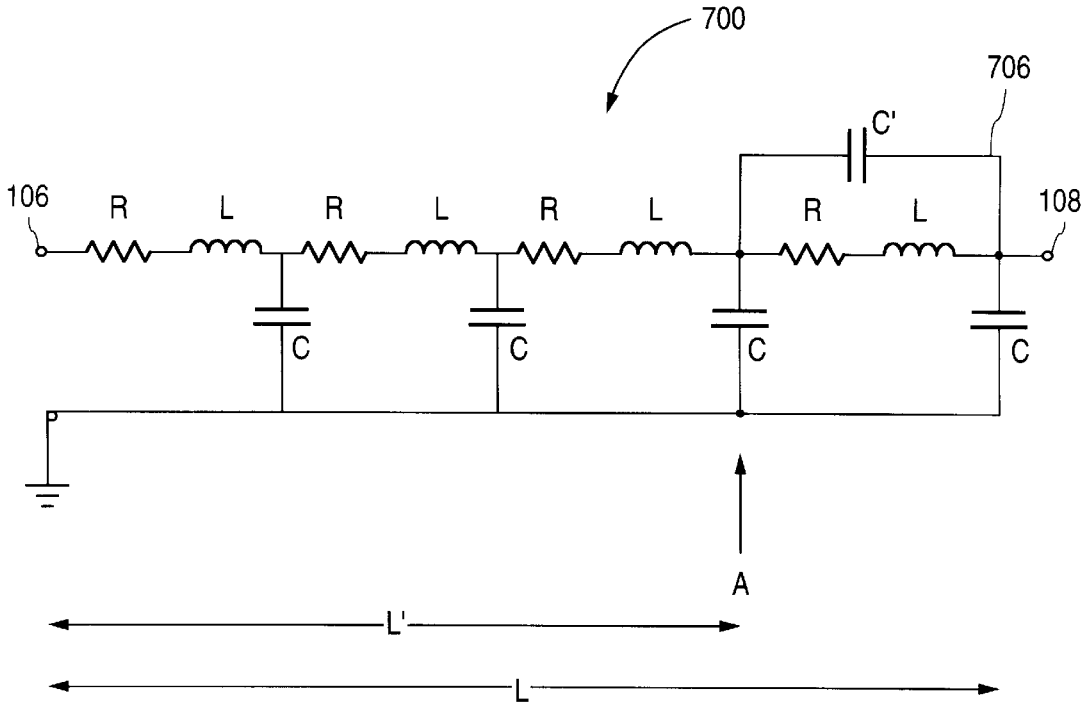
FIG. 7 schematically illustrates a transmission line model of a normal-mode helical antenna in accordance with the present invention.

FIG. 7 schematically illustrates a transmission line model 700 of the multiple-tuned normal-mode helical antenna 400 shown in FIG. 4. The transmission line model 700 is very similar to the transmission line model 300 of the conventional normal-mode helical antenna, except that the transmission line model 700 includes a capacitive element C' coupled across a portion of the original transmission line 300 (the portion of the original transmission line 300 across which the capacitive element C' is coupled is designated in FIG. 7 by reference numeral 404), to act electrically in parallel with the portion of the original transmission line 404.

The capacitance of C' is chosen such that it will resonate at the frequency of interest with the inductance L of the portion of the transmission line across which it is coupled. This is in accordance with well-known circuit theory, which provides that a parallel resonant tank appears as a open circuit at the resonant frequency.

By examination of the frequency response of the transmission line 700, the multiple resonance effect can be seen. If C' and L are chosen to resonate at 50 MHz, then at very low frequencies (less than 10 MHz), the effect of the capacitor C' is very slight. However, as the frequency nears 50 MHz, the resonant tank of C' and L will appear more inductive than the L only (i.e., without the capacitance), and the transmission line will appear slightly longer. This is why the resonance is further down in frequency. At exactly 50 MHz, the combination of C' and L will appear as a open circuit at point A which, when transformed by the helical transmission line geometry, will appear as 50 ohms at the feed end 106. At frequencies slightly beyond resonance, the parallel LC tank appears as a very small capacitive reactance, which has very little effect on the antenna response. Essentially, the addition of C' creates an additional open end 108 which will resonate at a slightly higher frequency than the resonance of an antenna without the C'.

Each of the open circuits are then transformed by the helical transmission line to 50 ohms at the feed end 106, at their respective frequencies.

Figure 5:
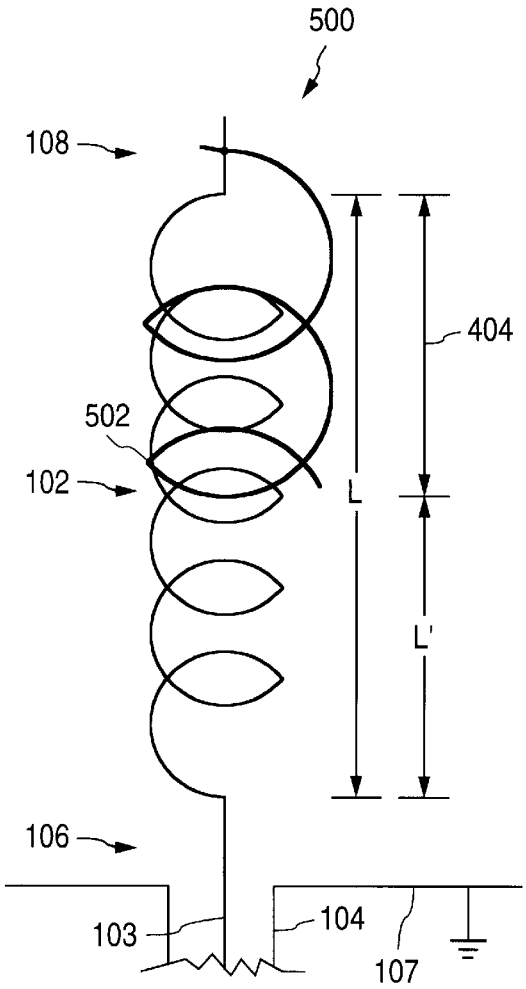
FIG. 5 shows a multiple-tuned normal-mode helical antenna in accordance with the second embodiment of the present invention.

FIG. 5 illustrates a multiple-tuned normal-mode helical antenna in accordance with a second embodiment 500 of the present invention. Referring to FIG. 5, in addition to the first conductive coil 102, which is similar to the conductive coil 102 of the conventional normal-mode helical antenna 100 of FIG. 1, the multiple-tuned normal-mode helical antenna in accordance with the second embodiment 500 of the present invention includes a second coil 502 of additional turns of the conducting wire with opposite (reverse) helicity relative to the windings of conductive coil 102. The reverse wound coil 502 has a length (L-L').

The reverse wound coil 502 overlaps the first coil 102 from the open end 108 of the first coil 102 to a point on the first coil 102 located a distance L' from the feed end 106 of the first coil 102. The reverse wound coil 502 and first coil 102 are concentric with one another. A thin physically and electrically insulating layer covers the cylindrical surface of the first coil 102. The reverse wound coil 502 is located outside of the first coil 102 and the thin layer, with a circumference only slightly greater than substantially that of the first coil 102. The first coil 102 is electrically coupled to the reverse wound coil 502, and in a preferred embodiment this coupling occurs at the open end 108 of the first coil 102. As will be discussed in more detail below, the reverse wound coil 502 has the effect of producing a capacitance that acts electrically in parallel with a portion (L-L') 404 of the first coil 102.

Specifically, the difference in frequency of the response maxima of an antenna in accordance with the first embodiment 400 or the second embodiment 500 of the present invention is determined by the value of the capacitance of the capacitive element 402,502 and the length L-L' of the portion 404 of the original coil 102 with which the capacitive element 402,502 acts electrically in parallel. There is a range of values of the capacitance of the capacitive element 402,502 which when acting electrically in parallel with a particular length L-L' of the original coil 102 will effect a frequency response that includes dual resonance frequencies of similar strength with an antiresonance notch located between the resonance frequencies (See, for example, the resonance frequencies 602,603 of FIG. 6). Since each turn of the original coil 102 is separated by a similar distance, the length L-L' corresponds to a number of turns of the original coil 102. For example, measured values of spacing between the resonance frequency maxima in the frequency response of a multiple-tuned normal-mode helical antenna in accordance with the first embodiment of the present invention as a function of different capacitance values of the capacitor circuitry 402 (which for these measurements is a capacitor) and the number of turns of the first coil 102 across which the capacitor circuitry 402 is connected are shown below:

| L–L' | CAPACITANCE (pF) | SPACING (MHz) |
|---|---|---|
| 50 | 2.2 | 13.0 |
| 40 | 3.7 | 11.5 |
| 30 | 4.9 | 9.2 |
| 20 | 8.8 | 6.0 |
| 10 | 22.5 | 4.1 |

Thus, it has been determined experimentally that the location of the resonance frequency maxima exhibited by a multiple-tuned normal-mode helical antenna in accordance with the first embodiment of the present invention, relative to a single frequency maximum exhibited by a conventional normal-mode helical antenna, is a function of both the capacitance value of the capacitor circuitry 402 and the number of turns or portion 404 of the first coil 102 across which the capacitive element 502 acts electrically in parallel. The capability of tuning a desired spacing between resonance frequency maxima of the frequency response of the multiple-tuned normal-mode helical antenna is an advantage of the present invention.

Figure 8:
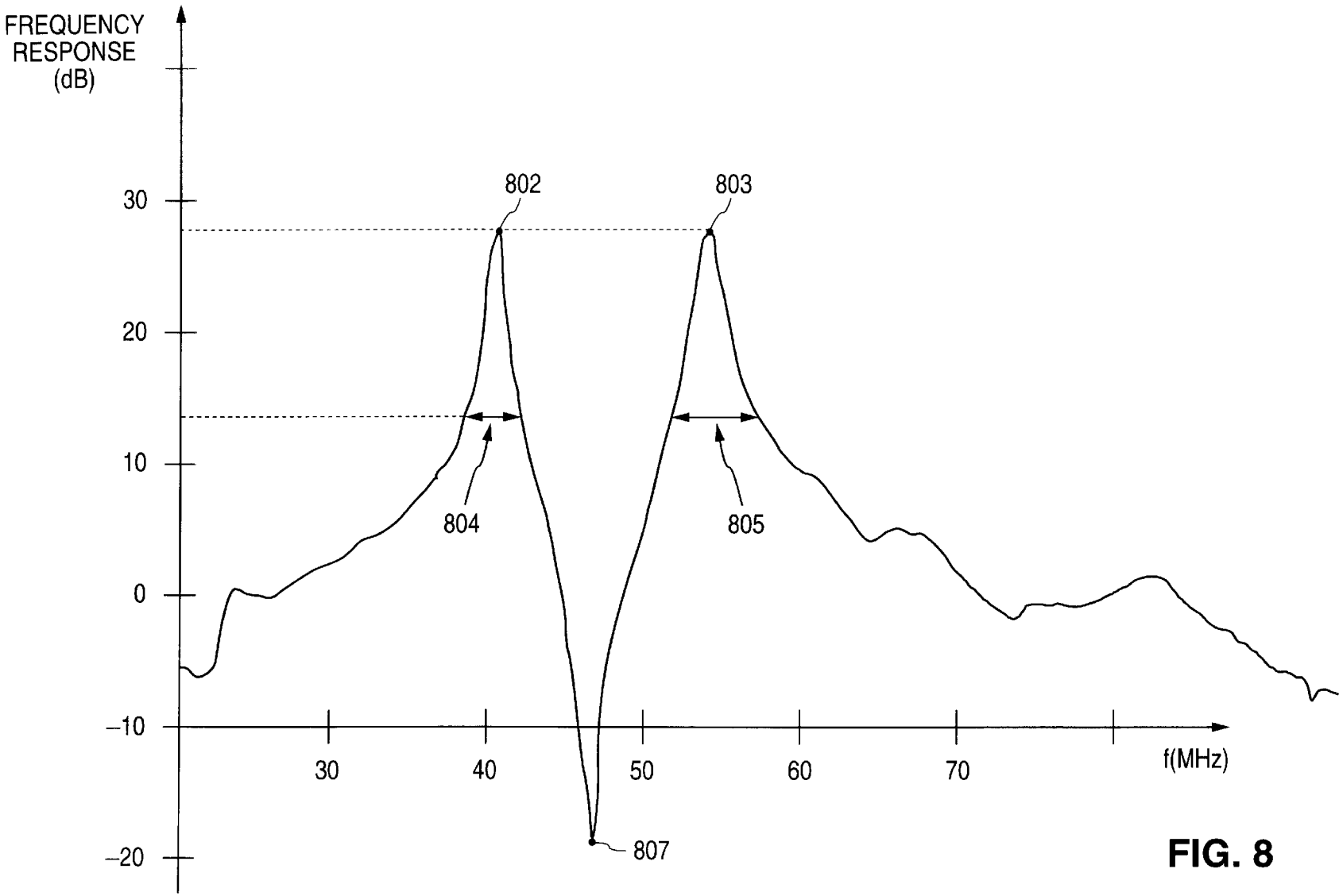
FIG. 8 shows the frequency response of the antenna of FIG. 5, having an 7.25 picofarad capacitor acting electrically in parallel with 23 turns of its conductive coil.

FIG. 8 illustrates that a multiple-tuned normal-mode helical antenna in accordance with the present invention can be tuned to exhibit a response having a desired frequency spacing. FIG. 8 shows the frequency response of a further multiple-tuned normal-mode helical antenna in accordance with the first embodiment 400. It can be seen that response shown in FIG. 8 is similar to that of the response shown in FIG. 6, except that normal-mode helical antenna 400 whose frequency response is shown in FIG. 8 has a capacitive element 502 whose capacitance is 7.25 picofarads, and the capacitive element 502 acts electrically in parallel with 23 turns of the conductive coil 102. Similar to the normal-mode helical antenna 400 whose frequency response is shown in FIG. 6, the normal-mode helical antenna 400 whose frequency response is shown in FIG. 8 also exhibits two resonances of similar magnitude to each other. By contrast, however, resonance 802 is at 42 MHz (as opposed to resonance 602 which is located at 43 MHz) and resonance 803 is at 54 MHz (as opposed to resonance 603 which is located at 51 MHz).

The normal-mode antenna 400 whose frequency response is illustrated in FIG. 8 has the following characteristics:

| | |
|---|---|
| resonance frequencies (802, 803) | ~42 MHz, ~54 MHz, respectively |
| frequency of antiresonance notch (807) | ~46.7 MHz |
| 3dB bandwidths (804, 805) | ~1 MHz |
| number of turns of first coil (102) | 150 |
| capacitance of capacitor (402) | 3.6 pF |
| number of turns of first coil (102) with which capacitor (402) acts in parallel (404) | 47 |
| diameter of first coil (102) | 0.25" |
| physical length (L) of first coil (102) | 2.9" |

Still referring to FIG. 8, it can also be seen from this figure that the addition of the capacitor circuitry 402 increases the Q-factor of the multiple-tuned normal-mode helical antenna 400 relative to a convention normal-mode antenna 100 otherwise having the same characteristics. The Q is increased by parallel LC tank at the open end 108 of the multiple-tuned normal-mode helical antenna in accordance with the first embodiment 400 of the present invention relative to that of a conventional normal-mode helical antenna 100. That is, the resonance frequency peaks 802,803 exhibited by the multiple-tuned normal-mode helical antenna in accordance with the first embodiment 400 have a greater peak-to-width ratio than that exhibited by the conventional normal-mode helical antenna 100. This high Q effects highly resolved resonance frequency peaks 802,803 which exhibit little or no overlap such that an antiresonance notch 807 can be seen to be located midpoint between the resonance frequencies 802,803 (See also FIG. 6).

The advantage of an antenna 400, 500 in accordance with the present invention 400,500 can be seen clearly by comparing FIG. 2 to FIG. 6. In particular, it is possible to apply an antenna in accordance with the present invention to a radio transceiver system in at least two ways. First, both response maxima may be used, one at the receiver frequency and one at the transmitter frequency. When a conventional normal-mode helical antenna 100, which has only one resonance frequency 202, is incorporated for use with two desired frequencies, the performance of a conventional normal-mode helical antenna at each frequency is down by, e.g., 15 to 20 dB relative to the performance of an antenna in accordance with the present invention. In an alternative application, one response maxima may be used and the antiresonance notch may be used, with the response maxima placed at the receiver frequency and the notch placed at the transmitter frequency, thereby significantly reducing the transmitter signal interference with the receiver and avoiding the need for duplexing circuitry at the front end of the receiver.

Figure 9:
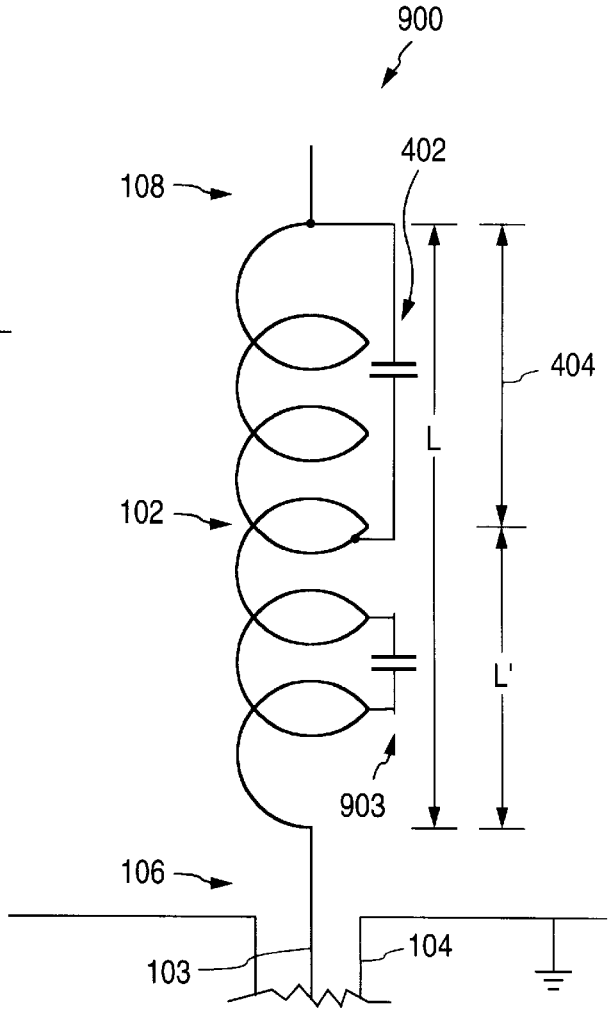
FIG. 9 shows a multiple-tuned normal-mode helical antenna in accordance with the third embodiment of the present invention.

FIG. 9 illustrates a multiple-tuned normal-mode helical antenna in accordance with a third embodiment 900 of the present invention. Referring to FIG. 9, a multiple-tuned normal-mode helical antenna in accordance with the third embodiment 900 includes a conductive coil 102 and a plurality of capacitor circuits 402,903 coupled to the conductive coil 102 to act electrically in parallel with portions 404,905 of the conductive coil. FIG. 9 is only illustrative of the third embodiment 900; the third embodiment can include two or more capacitor circuits each coupled to the conductive coil 102 to act electrically in parallel with two or more portions of the conductive coil 102. The number of resonance frequency maxima in the frequency response spectrum of the third embodiment increases as the number of capacitor circuits coupled to the conductive coil 102 to act electrically in parallel with the conductive coil 102 is increased. Antiresonance notches are located midpoint between each pair of adjacent resonance frequency maxima.

Figure 10:
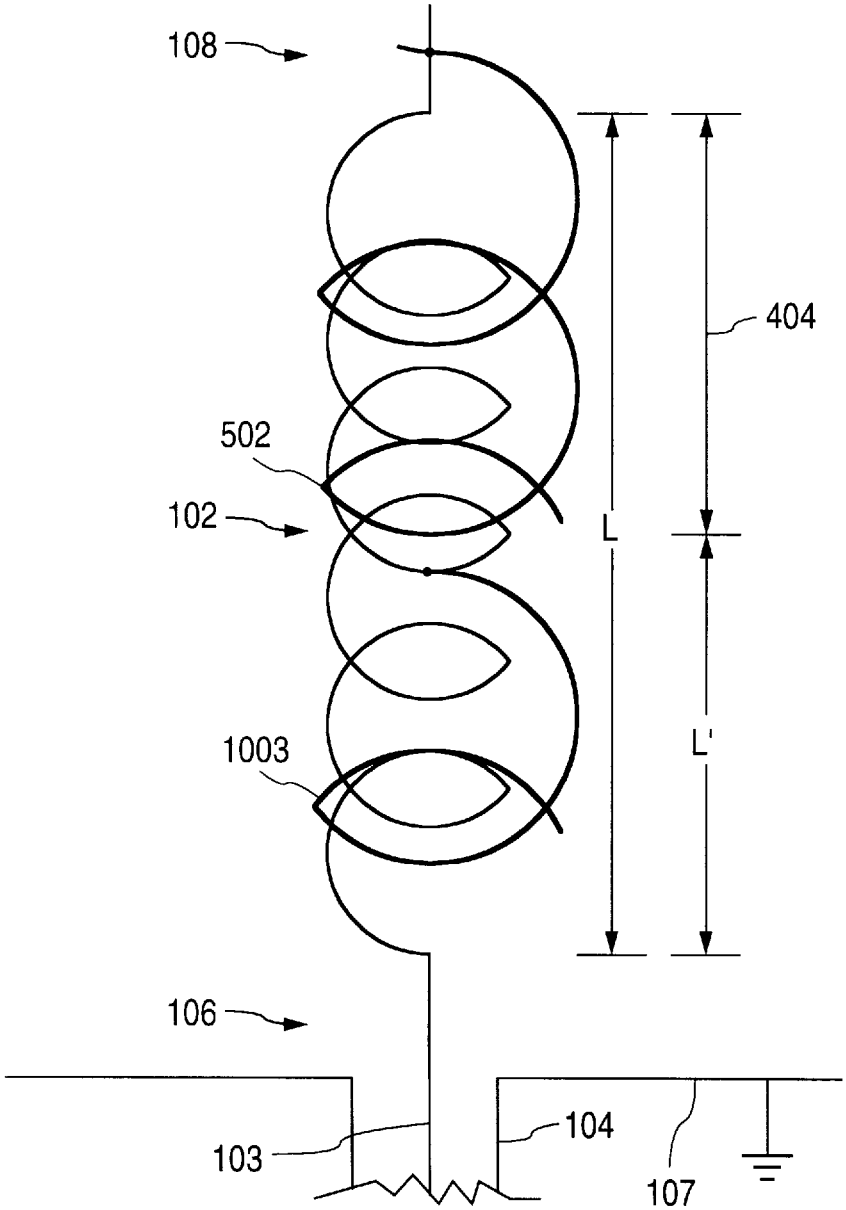
FIG. 10 shows a multiple-tuned normal-mode helical antenna in accordance with the fourth embodiment of the present invention.

FIG. 10 illustrates a multiple-tuned normal-mode helical antenna in accordance with a forth embodiment 1000 of the present invention. Referring to FIG. 10, a multiple-tuned normal-mode helical antenna in accordance with the forth embodiment 1000 includes a conductive coil 102 and a plurality of reverse wound coils 502,1003 coupled to the conductive coil 102 to act electrically in parallel with portions 404,905 of the conductive coil 102. FIG. 10 is only illustrative of the forth embodiment 1000 which can include two or more reverse wound coils coupled to the conductive coil 102 to act electrically in parallel with two or more portions of the conductive coil 102. The number of resonance frequency maxima in the frequency response spectrum of the forth embodiment 1000 increases as the number of capacitor circuits coupled to the conductive coil 102 to act electrically in parallel with the conductive coil 102 is increased. Antiresonance notches are located midpoint between each pair of adjacent resonance frequency maxima.

The antiresonance notch(es) provide an advantage even when multiple resonance frequencies are not required. In particular, an antenna in accordance with the present invention is operable in a single frequency mode with the added advantage of having an anti-resonance notch that can be placed at a selected frequency, where it is desirable to reject signals having the selected frequency. Appropriate selection of the number of turns of the conductive coil 102 across which the capacitive element(s) 402,502,903,1003 act(s) electrically in parallel and the physical dimensions of the coil 102, including circumference determine the resonance frequencies, and the value of the capacitance of the capacitive element(s) 402,502,903,1003 determine(s) the frequency or frequencies at which the anti-resonance notch resides.

It should be understood that various alternatives to the embodiments of the invention described herein may be employed in practicing the invention. It is intended that the following claims define the scope of the invention and that methods and apparatus within the scope of these claims and their equivalents be covered thereby.

What is claimed is:

1. An antenna for coupling to a wave launching structure, comprising:

a conductive coil having a first end and a second end, the first end being coupled to the wave launching structure; and capacitance creating means coupled to the conductive coil for creating a capacitance that acts electrically in parallel with at least one portion of the conductive coil, wherein the capacitance creating means creates an amount of capacitance that acts electrically in parallel with the at least one portion of the conductive coil to cause the antenna to exhibit a frequency response having at least a first resonance frequency and a second resonance frequency.

2. An antenna as set forth in claim 1, wherein the conductive coil has an electrical length approximately equal to one quarter of one wavelength at antenna operating frequencies, the operating frequencies being greater than 1 MHz and less than 1 GHz.

3. An antenna as set forth in claim 1, wherein the conductive coil has a circumference and a length, the circumference and length each being less than or equal to one half of one wavelength at antenna operating frequencies, the antenna operating frequencies being greater than 1 MHz and less than 1 GHz such that the antenna is a normal-mode helical antenna.

4. An antenna as set forth in claim 1, wherein the conductive coil surrounds an electrically insulative material.

5. An antenna as set forth in claim 1, wherein the capacitance creating means includes a capacitive element coupled across the at least one portion of the conductive coil.

6. An antenna as set forth in claim 1, wherein the conductive coil is a first conductive coil, characterized by a first helicity, and the capacitance creating means includes a second conductive coil electrically coupled to the first conductive coil and having a second helicity that is opposite the first helicity.

7. An antenna as set forth in claim 6, wherein the second conductive coil is coupled to the second end of the first conductive coil.

8. An antenna as set forth in claim 1, wherein the wave launching structure is a coaxial cable having an outer conductor electrically connected to a ground plane, and having an inner conductor, wherein the first end of the conductive coil is connectable to the inner conductor of the coaxial cable.

9. An antenna for coupling to a wave launching structure, comprising:

a conductive coil having a first end and a second end, the first end being coupled to the wave launching structure; and capacitance creating means coupled to the conductive coil for creating a capacitance that acts electrically in parallel with at least one portion of the conductive coil, wherein the capacitance creating means creates an amount of capacitance that acts electrically in parallel with the at least one portion of the conductive coil such that the antenna exhibits a frequency response having at least a first resonance frequency and a second resonance frequency, and wherein the capacitance created by the capacitance creating means that acts electrically in parallel with the at least one portion of the conductive coil is an amount of capacitance such that the frequency response exhibited by the antenna also has at least one antiresonance notch located between the first resonance frequency and the second resonance frequency.

10. An antenna as set forth in claim 9, wherein the second resonance frequency is higher, but by less than fifty percent, than the first resonance frequency.

11. An antenna for coupling to a wave launching structure, comprising:

a conductive coil having a first end and a second end, the first end being coupled to the wave launching structure: and capacitance creating means coupled to the conductive coil for creating a capacitance that acts electrically in parallel with at least one portion of the conductive coil, wherein at least one portion of the conductive coil with which the capacitance creating means is coupled to act electrically in parallel is a portion of the conductive coil between the second end of the conductive coil and a point of the conductive coil between the first end of the conductive coil and the second end of the conductive coil.

12. An antenna for coupling to a wave launching structure, comprising:

a conductive coil having a first end and a second end, the first end being coupled to the wave launching structure; and capacitance creating means coupled to the conductive coil for creating a capacitance that acts electrically in parallel with at least one portion of the conductive coil, wherein the capacitance creating means includes a plurality of capacitive elements and the at least one portion of the conductive coil includes a plurality of distinct portions of the conductive coil, wherein each of the plurality of capacitive elements is coupled to act electrically in parallel with a separate one of the distinct portions of the conductive coil.

13. An antenna for coupling to a wave launching structure, comprising:

a conductive coil having a first end and a second end, the first end being coupled to the wave launching structure; and capacitance creating means coupled to the conductive coil for creating a capacitance that acts electrically in parallel with at least one portion of the conductive coil, wherein the conductive coil is a first conductive coil, characterized by a first helicity, and the capacitance creating means includes a second conductive coil electrically coupled to the first conductive coil and having a second helicity that is opposite the first helicity, and wherein the second conductive coil is coupled to the second end of the first conductive coil, and wherein the second conductive coil is concentric with the first conductive coil.

14. An antenna as set forth in claim 13, wherein the length of the second conductive coil is less than the length of the first conductive coil.

15. An antenna for coupling to a wave launching structure, comprising:

a first conductive coil, characterized by a first helicity, having a first end and a second end, the first end being electrically coupled to the wave launching structure; and a second conductive coil, coupled to the first conductive coil, electrically coupled to the first conductive coil and being characterized by a second helicity that is opposite the first helicity, wherein the second conductive coil overlaps at least a portion of the first conductive coil.

16. An antenna as set forth in claim 15, wherein the wave launching structure is a coaxial cable having an outer conductor electrically connected to a ground plane, and having an inner conductor, wherein the first end of the conductive coil is connectable to the inner conductor of the coaxial cable.

17. An antenna for coupling to a wave launching structure, comprising:

a first conductive coil, characterized by a first helicity, having a first end and a second end, the first end being electrically coupled to the wave launching structure; and a second conductive coil, coupled to the first conductive coil, electrically coupled to the first conductive coil and being characterized by a second helicity that is opposite the first helicity, wherein the second conductive coil is coupled to the second end of the first conductive coil, and the second conductive coil overlaps at least a portion of the first conductive coil.

18. An antenna as set forth in claim 17, wherein the second conductive coil is concentric with the first conductive coil.

19. An antenna as set forth in claim 17, wherein the length of the second conductive coil is less than the length of the first conductive coil.

* * * * *